US007101117B1

(12) United States Patent
Chow

(10) Patent No.: US 7,101,117 B1
(45) Date of Patent: Sep. 5, 2006

(54) MINIMIZED WAVE-ZONE BUOYANCY PLATFORM

(76) Inventor: Andrew W. Chow, 15306 Parkville Dr., Houston, TX (US) 77068

( * ) Notice: Subject to any disclaimer, the term of this patent is extended or adjusted under 35 U.S.C. 154(b) by 0 days.

(21) Appl. No.: 11/159,089

(22) Filed: Jun. 23, 2005

(51) Int. Cl.
*B63B 35/44* (2006.01)

(52) U.S. Cl. ..... 405/201; 405/223.1; 405/224; 114/256; 114/264

(58) Field of Classification Search ..... 405/196, 405/200, 203, 204, 205, 206, 207, 209, 210, 405/211, 223.1, 224.2, 224.4; 114/264–266, 114/256
See application file for complete search history.

(56) References Cited

U.S. PATENT DOCUMENTS 3,472,032 A * 10/1969 Howard ..... 405/210
3,709,307 A * 1/1973 Clark ..... 114/264
4,048,943 A * 9/1977 Gerwick, Jr. ..... 405/211
4,168,556 A * 9/1979 Fink et al. ..... 114/264
4,473,323 A * 9/1984 Gregory ..... 405/224.4
4,606,673 A * 8/1986 Daniell ..... 405/210
5,609,442 A * 3/1997 Horton ..... 405/205
6,869,251 B1 * 3/2005 Zou et al. ..... 405/205
2005/0013669 A1 * 1/2005 Leverette et al. ..... 405/223.1

* cited by examiner

*Primary Examiner*—Frederick L. Lagman

(57) ABSTRACT

Minimized Wave-zone Buoyancy is a new approach to oil and gas platform design with superior construction and performance characteristics compared to state-of-art off-shore drilling and production platforms. Minimized Wave-zone Buoyancy platforms capitalize on low cross sectional area of the portion of the platform exposed to waves. The low cross sectional area reduces buoyancy forces that result from vertical platform movement, enabling the platform to oscillate at a low natural frequency. The low cross sectional area also minimizes the cyclical vertical forces induced by waves. Compare to current designs, application of the Minimized Wave-zone Buoyancy concept will result in a lower natural frequency of oscillation, lower overall weight of platform, or both. Minimized Wave-zone Buoyancy offers an attractive alternative with improved platform stability, fatigue considerations, lower construction and installation costs, and shorter implementation schedule.

2 Claims, 1 Drawing Sheet

MINIMIZED WAVE-ZONE BUOYANCY PLATFORM

This application is related to application Ser. No. 09/751,264, filed Jan. 2, 2001, now abandoned.

STATEMENT REGARDING FEDERALLY SPONSORED RESEARCH OR DEVELOPMENT not applicable

INCORPORATED BY REFERENCE OF MATERIAL SUBMITTED ON A COMPACT DISC not applicable

BACKGROUND OF THE INVENTION

Discussion of Current Deep-Water Floating Design

As oil and gas operations extend farther and farther out into deeper ocean areas, new technology has facilitated the petroleum industry's ability to manage production in more difficult environments. Installation of deep-draught platform, or structure with similar mass to wave-zone cross sectional area ratio, represents latest advancement to produce in deep-water frontiers. The platform floats and relies on its mass, or deep draught, for stability and for a low natural frequency of vertical oscillation.

The drawbacks of the current technology stem from high platform wave-zone buoyancy that leads to high forces on the structure from waves and swells. The negative consequences of not minimizing wave-zone buoyancy include: excessive ancillary structures, higher associated costs for materials, construction, and installation, extended schedule for construction and installation thus delaying start of oil and gas production, inferior performance such as less stable platforms and reduced portability, and shorter fatigue lives for components attached to the platforms.

BRIEF SUMMARY OF THE INVENTION

Minimized Wave-zone Buoyancy (hereinafter MWB) capitalizes on low platform cross sections at the wave zone. With main purpose of transmitting superstructure weight including those of facilities and equipment to the substructure which provides buoyancy and stability, low cross sectional area of the MWB structure enables low platform natural frequency of oscillation and minimizes cyclical vertical forces from waves. With physics governed by spring-mass type motion and dynamics explained by differential equation, MWB shows the way to steady platforms for improved drilling operations, with reduced vertical motion to enhance fatigue consideration for attached production components. Compared to current designs, MWB offers an attractive alternative with improved platform stability, fatigue considerations, lower construction and installation costs, and shorter implementation schedule for earlier first oil production. MWB platforms can be constructed at lower costs compared to similar off-shore structures in used or being designed today.

DETAIL DESCRIPTION OF THE INVENTION

Physics of Dynamics of Motion

Figure 2:
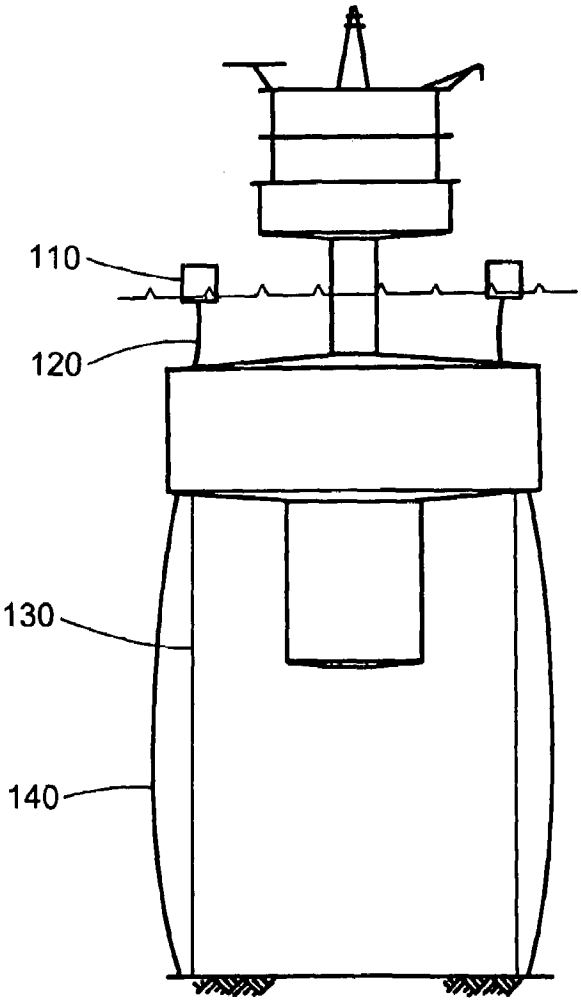
FIG. 2 shows a Minimized Wave-zone Buoyancy platform held to the ocean floor by tension cables or chains.

Dynamics of motion is governed by a commonly known differential equation $$MA+CV+KX=F(t)$$

which basically represents a balance of forces. In essence the sum of mass times acceleration, friction forces related to velocity, and distance-proportional reactive forces must be equal to the forcing function. Engineers can model complicated structures by developing mass and stiffness matrices and solve for numerical solutions. In the case of earthquake analysis, such as for an above-ground petroleum pipeline like the one in Alaska, the forcing function could be a seismic event's ground-motion that drives the structure's dynamic response over time.

As a floating production platform behaves like a rigid body bobbing in water, the dynamic equation of motion degenerates to the most basic one degree of freedom spring mass type system where the natural frequency of oscillation, ω, for the solution to the stated differential equation is defined by the following equation $$\omega=(K/M)^{1/2}/2\pi$$

For a floating object, the distance proportional K is the incremental buoyancy force for one unit of vertical displacement, which is the product of water displacement change times the density of water for that unit of vertical movement. Combining this attribute of K with the fact that mass is equal to weight divided by gravity would yield $$K/M=A\ G/DV$$

where A is the water displacing cross sectional area at the wave zone, G is gravity, and DV is the water displacement volume of the platform. Therefore, a floating platform with uniform cross sectional area will have an ω that is proportional to the commonly known formula of (gravity/delta static)$^{1/2}$, and in this case, delta static is the static draught of the floating platform. Without knowing anything else except for draught, a vessel with a uniform cross section that sinks 700 feet should have an ω of about 2 cycles per minute. Combining the above two equations would yield the following for 700 feet, $$\omega=(AG/DV)^{1/2}/2\pi=(32\ \text{Ft/sec}^2/700\ \text{Ft})^{1/2}/(2\times3.14159)=2.048\ \text{cpm}$$

Therefore, as long as DV/A is greater than 700 feet, platform vertical natural frequency of oscillation would be less than 2.048 cycles per minute. Stated another way, as long as the wave-zone cross sectional area A is less than DV/700 feet, platform frequency would be less than 2.048 cpm. Engineers can now design. A to any specified ocean wave frequency requirements.

It would be obvious at this time to those knowledgeable of the art that a reduction of the distance-proportional K in the ω solution would produce a desired and, not surprisingly, dramatic result. In other words, reducing the cross sectional area A of the part of the platform that may be exposed to waves would enhance platform performance.

For benefit of readers not familiar with dynamics or differential equations, the implication of the ω solution can be visualized by the difference in bounce between a fully loaded truck and the same truck without the load. It would be obvious to a casual observer that the truck with a full load will bounce up and down at a slower frequency than the same truck empty. In both cases the truck has same suspension spring constant K, but the fully loaded version has more weight and thus a larger mass M. Therefore, the ω equation with the larger M in the denominator produces a lower frequency and supports our intuition that loaded trucks bounce slower than empty trucks.

In short, the frequency of platform vertical oscillation can be controlled by adjusting the platform's K/M ratio. A low frequency can be designed by reducing K, increasing M, or a combination of both, and reducing K means a smaller cross sectional area A in the wave zone of a platform, or for that matter any floating object, FSO for example, that may be under consideration.

Discussion of the Present Invention

The present invention benefits from reducing the buoyancy force change that results from a vertical displacement of a floating platform, in essence to lower the K in the differential and ω equations so as to reduce the platform's natural frequency of oscillation beyond the frequency range of ocean waves and to increase the frequency separation between platform resonance and ocean-wave frequencies. The platform would therefore operate in the tail end of the ocean waves' response spectra.

Figure 1:
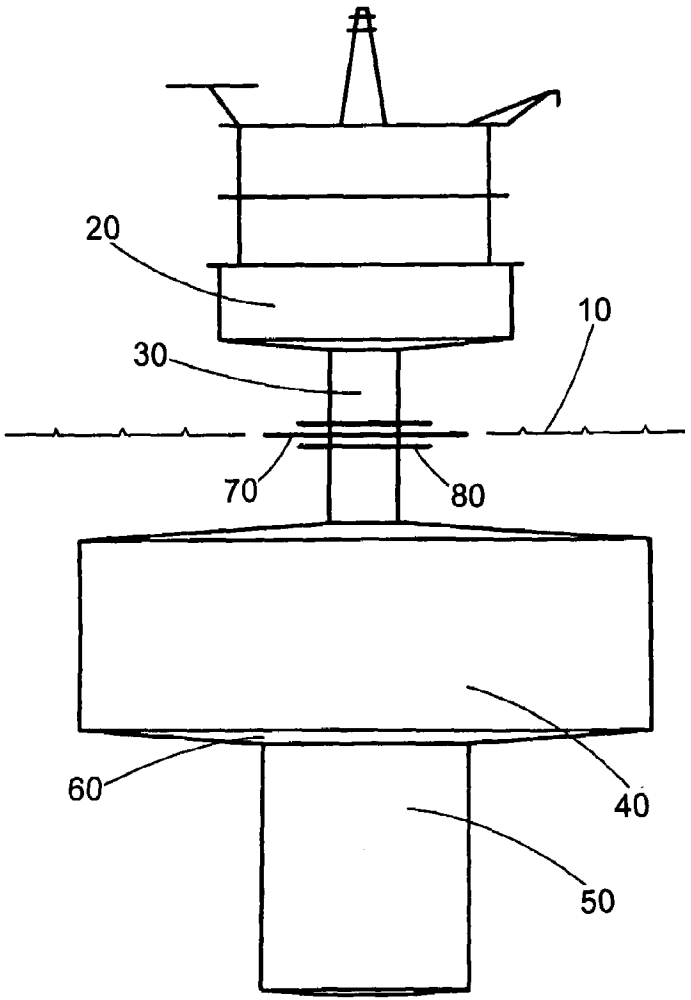
FIG. 1 shows a Minimized Wave-zone Buoyancy platform.

FIG. 1 shows an example of MWB platform floating at water level 10. An offshore platform provides space to house facilities and equipment required for drilling and production activities, and the platform has a superstructure 20 which provides space for such equipment and facilities. Superstructure 20 also provides buoyancy to keep the platform afloat in the event that water rises to the level of the superstructure.

An MWB structure 30 supports superstructure 20 and connects to substructure 40, 50, and 60. The height of the MWB structure 30 is designed so that the waves expected to impact the platform will strike the platform at the MWB structure 30. It is solely for convenience that FIG. 1 displays only one MWB structural unit with a hollow center for drill pipe access. The MWB structure 30 could comprise multiple columns or could be made as a braced truss, and the possibilities for MWB structure are limited only by designer imagination.

Since the objective is to minimize wave-zone buoyancy, the cross section of MWB structure 30 should consist mostly of steel, or other structural materials; the MWB structure's cross section should have limited air space to ensure a minimized buoyancy force change K in the equations previously stated. The shape and design of the MWB structure 30 do not matter and would not affect the overall dynamic performance of the platform as long as the water displaced by the MWB structure 20 is kept to a minimum. The primary function of the MWB structure 30 is not to provide buoyancy for the superstructure 20, but to transmit the weight of the superstructure 20 to the substructure 40, 50, and 60.

Substructure 40, 50, and 60 provides buoyancy for the platform. FIG. 1 shows an example with a float 40 and a ballast 50. The Float 40 has substantial width in comparison to height to enhance exponential damping from the C component of the stated differential equation. The width also serves the purpose of elevating the center of lift of the substructure. The Ballast 50 extends downwards and is weighted at the bottom with rocks, concrete, lead, or other dense material to ensure the center of gravity of the entire platform is sufficiently below the center of lift for overall stability. As shown in the example MWB platform, both float 40 and ballast 50 are cylindrical in shape; conical sections 60 with positive Gaussian curvature are included to enhance outer shell strength for the substructure.

It should be obvious to those knowledgeable of the art that substructure possibilities are in the designers' domain as in the case previously made for the MWB structure. The principles of center of gravity and center of lift/buoyancy are well known, and it is not the purpose of this patent to elaborate on the design of structures that may be suitable for subsurface floatation. This patent advances the concept of minimizing water displacement in the wave zone and the benefits from reducing incremental buoyancy forces due to waves, swells, and vertical platform movement.

As MWB structure 30 provides limited additional buoyancy capacity and to ensure platform stability with variable superstructure live loads, live load stabilizer 70 increases water displacement at water level 10. When the platform floats right at the water level, the natural frequency of oscillation is higher and corresponds to that of platforms with larger wave-zone cross sectional area. However, as the MWB platform moves slightly up or down beyond the height of the stabilizer 70, the benefit of small cross sectional area kicks in. Mathematically, the K in the differential equation in this case is no longer a constant; it varies with vertical distance.

For live loads with mass changes beyond the displacement capacity of live load stabilizer 70, an active platform weight management system could pump water in or out of ballast 50 to accommodate large changes. While this patent does not teach sensor usage for active ballast adjustment, live load stabilizer stoppers 80 would restrain large movement resulting from large live-load changes, to ensure that a weight management system would be activated to return live load stabilizer 70 to water level 10.

Live load stabilizer 70 and live load stabilizer stoppers 80 could be made in any shape, size, or material. Their sole purpose is to displace water. FIG. 1 shows them as plates, and they can be added or removed to meet operating requirements. For example, if constant large live load changes are expected, the displacement of live load stabilizer 70 could be increased. On the other hand, anticipation of a storm may cause all stabilizers and stoppers to be lifted out of the water.

In the foregoing discussion of stabilizers 70 and 80, the stabilizers are attached to the MWB structure 30. Another stabilizer example is a float attached to the MWB platform with loose chains or cables. Loose connections permit the MWB platform to behave in accordance with the differential equation until the platform has moved far enough to take up the chain or cable slack before engaging the floating stabilizer.

While discussion of this invention has focused on a free floating platform, the MWB concept applies to tension leg environment also. Again, it is not the intention of this patent to dwell on floatation designs, and it should be clear to those knowledgeable of the art what platform adaptations may be required for a tension platform.

FIG. 2 shows an MWB tension cable platform with floating stabilizers 110 attached by slack cables 120 to the platform. As discussed above, the float stabilizers 110 have no effect on dynamic movement until the platform has oscillated or moved far enough to take up the slack in the slack cables 120. Arrangement and design of stabilizers 110 are again limited only by designer imagination. For example, a big donut floating stabilizer could replace all floating stabilizers shown. A limited-free-movement means could permit the donut to slide freely up and down the MWB structure but would prevent the donut from moving beyond certain heights, for example, by obstructions welded on the MWB structure to limit movement. Therefore, the donut floating stabilizer would not provide buoyancy lift until the platform has sunk to a predetermine depth and would become a downward dead-weight force when it is lifted out of the water by the rising platform. It would be obvious that slack cables 120 and the sliding donut are just specific forms of limited-free-movement means.

Low stiffness cables 130 hold the platform to the bottom of the ocean. Related to the foregoing differential equation, the K for the MWB tension cable platform is the combination of the K from the cross section of the Minimized Wave Zone structure and the spring constant of the low stiffness cables 130. FIG. 2 shows high stiffness slack cables 140 with a slack to illustrate that the high stiffness slack cables 140 would not engage to inhibit platform upward movement until the platform has oscillated or risen far enough to take up the slack in the high stiffness slack cables 140.

Spring constant of the low stiffness cables can be easily determined, and actual springs may be added to provide additional flexibility. Also, the low stiffness cables 130 control natural frequency over a range of small displacements, and the high stiffness slack cables 140 provide the strong resistance force to restrain large vertical platform movement. Low stiffness cables 130 and high stiffness slack cables 140 together produce the effect of limited-free-movement means as in the previous discussion for floating stabilizers.

Compared to traditional tension leg platforms with high wave-zone cross sectional area and with all cables/chains having high stiffness and no slack, an MWB tension platform with minimized wave-zone cross section and low-stiffness cables anchored to the ocean floor has a lower combined K and will therefore resonate at a lower natural frequency of oscillation. The lower frequency means fewer fatigue cycles and thus a longer expected life for the platform's attached components for production.

It should be noted that in the limiting case, the K of the low stiffness cables may be reduced to zero. In other words the low stiffness cables could be eliminated for vertical dynamic consideration, and only the high stiffness cables remain to limit large vertical uplift. Again, it is not the intent of this patent to discuss ballast management to ensure platform buoyancy at the desired elevation as it would be obvious to those knowledgeable of the art. Also, horizontal restraints have been purposely ignored in the discussion of vertical dynamic response.

For benefit of readers not accustomed to dynamics and rigors of mathematics, it may be easier to consider the cyclic buoyancy forces induced by waves or swells on a traditional tension leg platform. The same waves or swells will produce lower cyclic buoyancy forces on an MWB platform due to the minimized wave-zone cross sectional area. So even if the frequency effects are ignored, it would still be obvious that MWB designs will have lower induced cyclic forces and thus longer fatigue lives.

CONCLUDING TECHNICAL REMARKS AND COST CONSIDERATIONS

The low wave-zone cross sectional area permits less massive structure compared to current platform designs while maintaining or improving the K/M ratio. Less mass translates to a lower requirement for steel, meaning lower cost and shorter time for construction. As the floating platform does not depend on deep draught for stability and for a long period of oscillation, the shallower draught of MWB platforms permits construction and assembly in a less hostile environment. For example, without ballast weight and with MWB tied down and floating high on the substructure, the entire platform including superstructure facilities could be constructed in a sheltered and controlled location. Of course, ballast weights would be added before deployment.

Naturally, the favorable characteristics mean that MWB platforms can be constructed at lower costs and faster schedules, shortening time of development and accelerating schedules when deep-sea oil and gas fields can be brought on line.

SEQUENCE LISTING not applicable

I claim:

1. A floating platform comprising:

a floating buoyancy capable superstructure;

a vertical movement damping substructure with surfaces extending sideways and having substantial width;

and a minimized wave-zone buoyancy structure having cross sectional area less than platform displacement divided by 300 feet and sufficient height above and below expected ocean waves;

with said minimized wave-zone buoyancy structure effective in transmitting said superstructure's weight to said substructure; and with the substructure capable of overall platform buoyancy and stability.

2. A floating platform according to claim 1, further comprising one or more cross sectional area increasing and vertically damping stabilizers attached to minimized wave-zone buoyancy structure at specified locations.

* * * * *